US005502895A

United States Patent [19]

Lemaire

[11] Patent Number: 5,502,895

[45] Date of Patent: Apr. 2, 1996

[54] FOLDING BLADE POCKET KNIFE

[76] Inventor: Denis Lemaire, 534, De La Vérendrye, Boucherville (Québec), Canada, J4B 2Y1

[21] Appl. No.: 363,945

[22] Filed: Dec. 27, 1994

[51] Int. Cl.[6] ..... B26B 1/02

[52] U.S. Cl. ..... 30/158; 30/160

[58] Field of Search ..... 30/158, 159, 160, 30/161

[56] References Cited

U.S. PATENT DOCUMENTS

| | | | |
|---|---|---|---|
| 1,931,360 | 10/1933 | Schrade | 30/159 |
| 4,095,337 | 6/1978 | Pharr | 30/158 |
| 4,177,560 | 12/1979 | Sakurai | 30/160 |
| 4,347,665 | 9/1982 | Glesser | 30/161 |
| 5,009,008 | 4/1991 | Yablonovitch | 30/158 |
| 5,331,741 | 7/1994 | Taylor, Jr. | 30/158 |

*Primary Examiner*—Hwei-Siu Payer

[57] ABSTRACT

A folding blade pocket knife including: an elongated handle, defining first and second lateral walls and a cross-sectionally U-shape lengthwise channel therebetween; an elongated cutting blade, sized to fit within the U-channel; a knurled rotary button, pivotally mounting an inner end of the cutting blade to a front end of the handle first wall; a liner lock assembly, including an elongated leaf spring blade, fixedly connected at a rear end thereof to a rear end of the handle second wall, and defining a front portion pretensioned toward and against a front portion of the handle first wall, whereby the leaf spring blade front portion extends transversely of the U-channel to prevent engagement of the cutting blade into the U-channel; and a slider operated cable for pulling the leaf spring blade front portion away from the handle first wall, whereby the leaf spring blade clears the U-channel to enable engagement of the cutting blade into the U-channel. The cutting blade is therefore pivotably between a retracted position, extending within the U-channel, and an extended operative position, extending away from the handle coaxially thereto. Manual rotation of the knurled rotary button allows manual blade extension, without contacting the blade and in an economically efficient fashion.

10 Claims, 4 Drawing Sheets

FOLDING BLADE POCKET KNIFE

CROSS-REFERENCE DATA

Disclosure document No 328,216 issued 29 Mar. 1993 to the present inventor, is hereby incorporated by way of reference to the present patent application.

FIELD OF THE INVENTION

This invention relates to knives of the type having a cutting blade pivotally mounted to the knife handle, and in particular, to folding blade lock knives which can be operated with a single hand.

BACKGROUND OF THE INVENTION

In folding blade knives, such as the well known "Swiss army" type knives, the cutting blade is pivotally carried at one end of the knife handle. To extend the blade from its retracted position, or to retract or "fold" the blade from its extended position, it is usually required for the user to grasp the handle with one hand, while the cutting blade is edge wisely held at its back edge between a few fingers of the user's other hand. Accordingly, the two hands of the user are usually required for handling these types of knives. Such an arrangement is not suitable for use by hunters, workmen, sailors and the like who must use one hand for holding the article and thereby leaving free a single hand to open a folded knife blade. It would be preferable if one hand could remain free at all times, for convenience.

U.S. Pat. No. 4,095,337 issued Jun. 20, 1978 to Cecil PHARR, discloses a folding blade lock knife that includes means for opening the blade on the handle with a single hand. These means consist of a U-shape bracket, being anchored edge wisely to the back edge of the blade, and carrying a transverse manual arm. A user may then hold the knife handle in his hand palm and with a few fingers of the same hand, while the thumb of that same hand may push the transverse arm to extend the blade from its folded position; folding of an extended blade is done in the usual fashion.

One problem with the PHARR patent is that two inverted versions of the folding blade knife are required, since the folding arm as installed for a left-handed person must be reversed for use by a right-handed person (see column 3, lines 20–28 of the specification). Another inconvenience with the PHARR folding blade knife is that a separate element must be added and attached edgewisely to the back edge of the blade, thus undesirably adding a blade thickening portion which would compromise deep cutting knife action with the extended blade.

In U.S. Pat. No. 4,347,665 issued 7 Sep. 1982 to Louis LESSER, there is disclosed a folding blade knife with the blade thereof being openable through the use of a single hand. A so-called liner lock blade locking mechanism is provided, for holding the blade in an extended operative position. The liner lock consists of a leaf spring arranged so that one end is attached to the spacer portion of the knife handle side portion by an interference fit in a corresponding slot, so that the spring cantilevers outwardly into a cavity of a blade inner cam. The leaf spring opens through and can be manually accessed via an aperture made in the knife handle. The leaf spring is arcuate to provide a normal bias against the underside of the lever of the blade inner cam. The cam causes the latch of the lever mechanism to drop into a corresponding notch made radially of inner cam.

A disadvantage of the LESSER patent is that, for extending the blade, the user still needs to grasp with his thumb an aperture boss at the back edge portion of the blade. The present inventor does not consider such blade extension method economically satisfactory, since the blade-contacting thumb needs to be much extended beyond the handle body and enter into an uncomfortable translational motion, leading to in comfort of the user.

Other known folding blade lock knives include a knife sold under the trademark LEOPARD CUB, manufactured and sold in the United States by the American corporation Bench made, Inc. Folding of the extended blade of the LEOPARD knife is again claimed to be a single-hand operation, being done by manually grasping a radial thumb lug opening stud, which transversely projects from the back edge portion of the knife blade proximate the pivotal mount thereof on the knife handle. Again, it is believed that the ergonomics involved in holding the knife handle and in pivoting the lug stud, both with the same single hand, could be improved, for comfort of the user.

OBJECTS OF THE INVENTION

The gist of the invention is therefore to provide a folding blade lock knife, in which the cutting blade can be comfortably brought both from retracted to fully extended position, with the same single hand as that hand holding the knife.

More particularly, an important feature of the invention is to provide an enlarged rotary button mounted to the knife handle for manually extending the blade from its folded condition.

An object of the invention is that the folding blade lock knife of the present invention comply fully with the weapons control regulatory environment.

Another object of the above-noted invention is to provide such a knife, which includes slider means for manually unlocking the blade from its fully extended operative position, the latter means being located on the knife handle and being actuatable by the same said single hand holding the knife.

A further object of the invention is to provide such a folding blade lock knife, which will be as good for a right-handed person as for a left-handed person, i.e. without requiring two different versions therefor.

A general object of the invention is to improve upon the ergonomics of folding blade lock knife art.

SUMMARY OF THE INVENTION

Accordingly with the objects of the invention, there is disclosed a folding blade knife comprising: (a) an elongated handle member, defining first and second, opposite, spacedly interconnected lateral walls and a lengthwise channel therebetween, and also defining front and rear ends; (b) an elongated blade member, sized to fit within said channel, and defining a free end tip and an opposite inner end; (c) a pivotal member, pivotally mounting said blade inner end to said handle front end, whereby said blade member is pivotable relative to said handle member between a folded position, extending within said channel, and an extended position, clearing said channel; and (d) an enlarged manual blade extension member, carried by said pivotal member for enabling manual pivoting of said blade member about the pivotal axis of said pivotal member; wherein a single user's hand is required for both supporting said handle member and for operating said blade extension member.

Preferably, blade locking means are further provided, for releasably locking said blade member in a fully extended operative position in which said handle member and said blade member are coaxial. Said blade locking means could then include a liner lock assembly, said liner lock assembly comprising a liner lock plate member anchored to the interior face defined by said handle first wall; said liner lock assembly including an elongated leaf spring finger, said finger being pretensioned in transversely offset fashion toward and against a front portion of said handle second wall, whereby said finger extends obliquely of said channel so as to be adapted to prevent engagement of said blade member into said channel; said blade inner end including a sector shape lock notch, said blade notch releasably engaged by said finger automatically under the pretensioned bias thereof when said blade member reaches said operative fully extended condition thereof; and further including means for forcibly pulling said finger transversely away from said handle second wall, against its inherent transverse bias, whereby said finger clears said channel to enable free engagement of said blade member into said channel. The pulling means could include a cable member, extending through a transverse bore made in the front portion of said handle first wall and fixedly connected at an inner end thereof to said transversely offset finger, and defining an outer end portion thereof projecting outwardly of said handle second wall. The blade extension member should preferably be located about said handle first wall front portion and closely proximate the portion of said cable member projecting outwardly from said handle first wall transverse bore. A slider block member would preferably be slidingly carried within a recess made on an exterior face of said handle first wall, wherein said cable member outer end portion is fixedly secured to said slider block member. The outer surface of said slider block member forms preferably a generally planar, knurled surface.

It is envisioned that said blade member inner end includes a sector-shape lock notch, said sector-shape lock notch for accommodating and seating the front end portion of said leaf spring member in said extended operative position of said blade member, whereby said blade member becomes releasably locked into said operative position. Said blade pivotal member could then include an enlarged discoid head, said discoid head freely engaging an arcuate notch made in the front end of said handle first wall, whereby edgewise manual rotation of said pivotal member head provides concurrent rotation of said blade member. This discoid head preferably includes a knurled circumferential edge.

Advantageously, there is further provided a J-shape base wall, integrally joining said handle lateral walls on their side opposite said channel, whereby the arcuate end portion formed by the J of the J-shape base wall defines an area for accommodating said blade end tip, whereby said blade tip extends short of and is concealed by the registering section of said handle lateral side walls when said blade member occupies its said folded position.

DETAILED DESCRIPTION OF THE DRAWINGS

Figure 2:
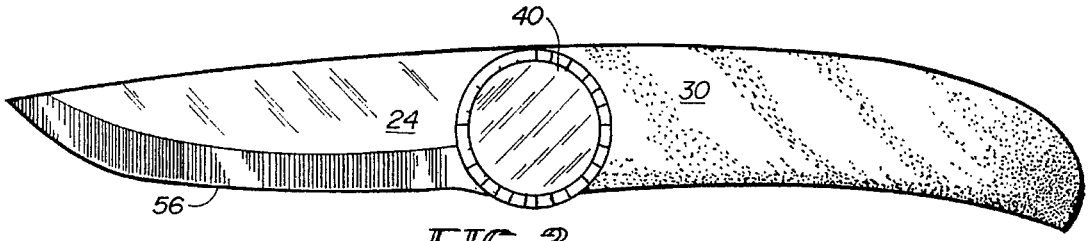
FIGS. 1 and 2 are edge and plan views, respectively, of a preferred embodiment of folding blade lock knife according to the invention, with the cutting blade in extended position.
Figure 1:
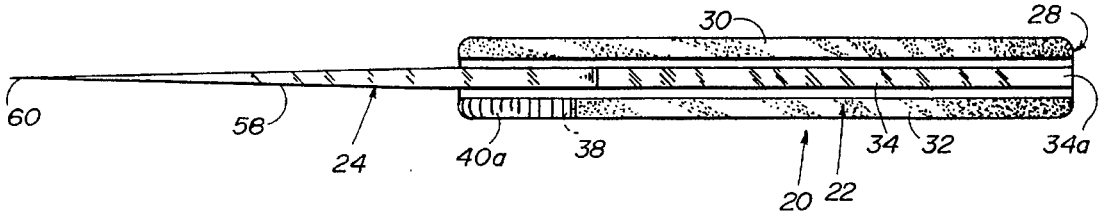

As illustrated in FIGS. 1–4 of the drawings, knife 20 includes an elongated handle 22 and a large folding blade 24 pivotally carried at one end of the handle. Handle 22 includes a main frame 28, of cross-sectionally U-shape, defining two flat lateral side walls 30, 32. Walls 30, 32, are spacedly interconnected in the known fashion by rivets (not shown), and by an edgewisely carried spacer member which takes the form of a base leg 34, whereby a lengthwise U-shape channel 36 is formed between the two walls 30, 32. Preferably, base leg 34 is J-shape and fashioned from the extra thickness provided on the side walls 30, 32, along the marginal edge portion thereof. Both the front and the rear ends of the elongated handle 22 are preferably arcuately shaped, for comfort of the user. Wall 32 forms an arcuate notch 38 at the front end thereof, for accommodating a rotary button 40. The end of leg 34 opposite blade 24 is indicated as **34*a* in FIG. 1**.

Rotary button 40 is preferably of discoid shape, with a transverse threaded axial pin 42.

Threaded pin 42 freely engages through a diametrally larger bore 72 (FIG. 6) made at the end portion of a liner lock plate 70 (detailed later)—which is mounted against the inner face **32*a* of wall 32—, and threadingly engages with a diametrally complementary bore 43 (FIG. 14) made at the inner end of cutting blade 24, whereby rotary button 40 and blade 24 become integral to one another. Hence, rotation of rotary button 40 brings blade 24 in concurrent pivotal rotation about the axis of rotary button pivot pin 42**.

Preferably, the front portion of the peripheral contour of rotary button 40 matches the arcuate contour of the front end of the other lateral wall 30, in transverse register therewith. Preferably also, the circumferential edge **40*a* of rotary button 40 is knurled (FIG. 7**), for facilitating edgewise manual rotation thereof (as will be detailed hereinbelow).

Figure 3:
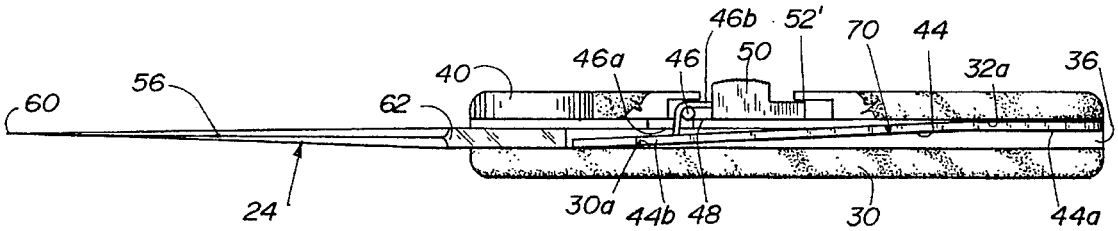
Figure 6:
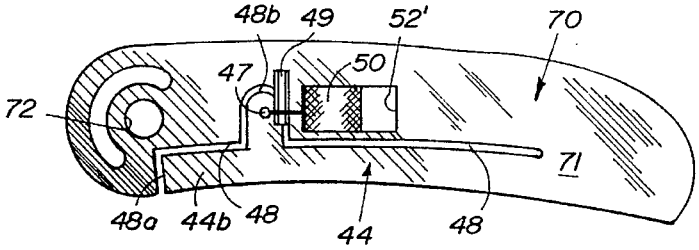
FIG. 6 is a plan view of the liner lock plate, and associated draw cable slider and guide roller, being shown in released condition.
Figure 5:
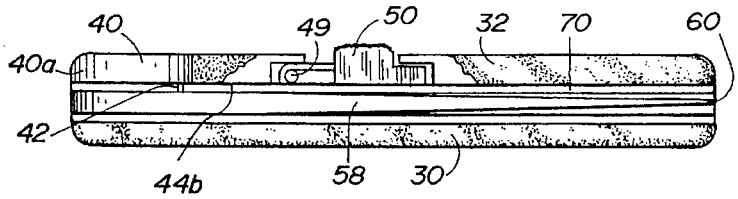
FIG. 5 is a view similar to FIG. 4, but with the blade being in its folded condition.
Figure 10:
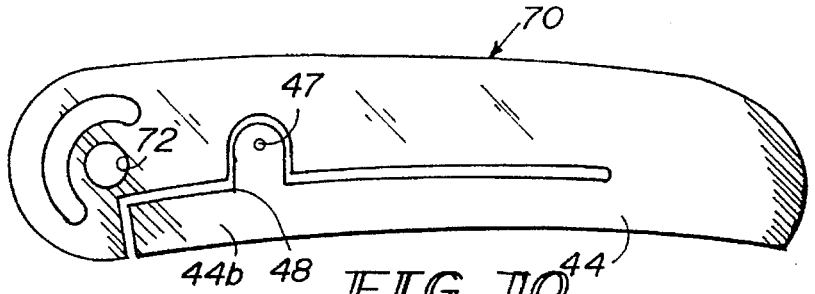
FIG. 10 is a view similar to FIG. 6, but showing solely the liner lock plate.
Figure 11:
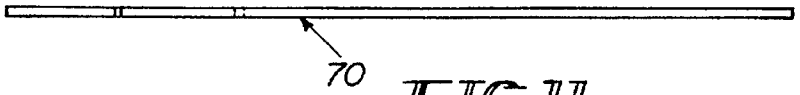
FIGS. 11 and 12 are edge views of the liner lock plate, with the leaf spring blade portion thereof being respectively in its blade unlocking and blade locking position.

As clearly illustrated in FIGS. 6 and 10, and as suggested in FIGS. 3 and 5, a liner lock plate 70 is mounted within U-channel 36, being applied flatly against the inner face **32*a*** of wall 32. Liner lock plate 70 has a general shape substantially matching that of handle 22, whereby plate 70 comes in direct flat engagement with—and is taken in sandwich between—the discoid rotary button 40 and the inner end portion 62 of blade 24. Liner lock plate 70 operates in the conventional fashion to releasably lock the blade 24 in its extended condition (FIG. 3), and accordingly, does not make part as such of the invention. However, liner lock plate 70 needs to be slightly modified and be adapted to accommodate the requirements of the present invention.

Figure 12:
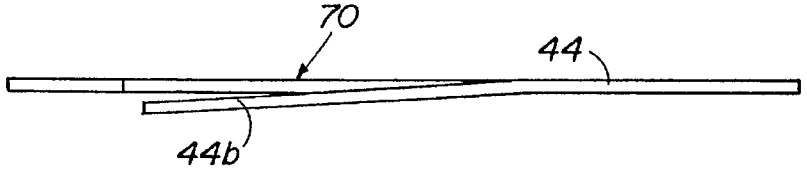

Liner lock plate 70 consists of a main metallic sheet 71 having a generally lengthwise slot 48. Slot 48 includes a transverse section 48*a*, located beneath the end bore 72 of sheet 71 and opening through the long arcuate edge of plate 70; and an intermediate inversely U-shape section 48*b*. Slit 48 thus defines an edgewise, generally rectangular underlying strip 44 forming an integral leaf spring blade member. Strip 44 includes a free end finger, 44*b*, which is pretensioned in a laterally offset position (FIG. 12) relative to the general plane of the otherwise flat liner lock plate 70.

Blade member 44 extends within the handle channel 36. As suggested in FIG. 3, leaf spring blade member 44 is pretensioned so that its front portion 44*b* (adjacent slit aperture 48*a*) be inherently biased toward and against the interior face 30*a* of transversely opposite handle frame side wall 30. In other words, the front blade portion 44*b* extends obliquely across the handle U-channel 36, in register with rotary knob 40.

A draw cable member 46 is transversely anchored at its inner end 46*a* to the leaf blade finger 44*b*, and extends through a registering bore 47 made through the liner lock plate 71, and into a rectangular registering aperture 52 in wall 32. An idle roller 49 (FIGS. 5 and 6) is mounted to wall 32 within aperture 52, to guide and deflect draw cable member at its outer end, 46*b*, toward a T-shape slider block 50, to which it is anchored. This slider block 50 is kept inside cavity 52 by outer retaining lips 52', made on the exterior face 32*b* of handle side wall 32. Slider block 50 is slidable within the recess 52 lengthwisely of the elongated handle wall 32. Slider block 50 is slidable between a first "rest" limit position, proximate rotary button 40, where leaf spring blade front portion 44*b* freely abuts against the interior face 30*a* of wall 30 yieldingly under the pre-tensioning bias thereof, and a second limit position, when the slider has been forcibly pushed spacedly away from rotary button 40, and where leaf spring blade front portion 44*b* is drawn by cable 46 to abut against the interior face 32*a* of wall 32 against the pre-tensioning bias of the leaf spring 44, thus transversely clearing U-channel 36. Preferably, the outer surface of slider block 50 is knurled, as was the case for the circumferential edge of the rotary button 40, for facilitating manual sliding displacement thereof.

Cutting blade 24 is clearly illustrated in FIGS. 2, 4, and 13–14, and includes a main, flat, elongated sheet section 54, with a sharp, thin, arcuate, cutting edge 56 and an opposite, thick, straight, back edge 58, with edges 56 and 58 merging about a sharp tip 60 at the outer free end of blade 24. The inner end portion 62 of blade 24 is thick and generally semi-circular, so as to define a general discoid shape sized to correspond substantially to that of discoid knob 40. The blade inner end portion 62 is lodged within the front end of U-channel 36, frontwardly of the leaf spring blade anchor point 46*a* of the draw cable 46, and in transverse register with discoid knob 40. The cutting blade inner end portion 62 and the rotary button 40 are fixedly interconnected by the knob pin 42. The cutting blade 24 is oriented in such a fashion that, upon elongated blade 24 projecting away from handle 22 coaxially thereto, cutting blade sharp edge 56 and handle U-channel 36 will be directed in the same direction.

Accordingly, by rotating rotary button 40, cutting blade 24 is brought into rotation therewith, whereby the cutting blade 24 can be brought into handle U-channel 36 in a folded position, with the sharp edge 56 being the leading edge (i.e., engaging first the U-channel 36). In its folded position, the cutting blade main flat section 54 extends into U-channel 36 between the liner lock plate 70 and the handle wall 30; for this to occur, slider block 50 must previously be slided rearwardly (i.e. away from rotary button 40), to draw cable 46 and associated front end portion 44*b* of the liner lock plate 70 toward handle wall 32, so as to clear U-channel 36. During this pivotal motion of the cutting blade 24 from its fully extended operative position (extending away from the handle 22 and coaxially thereto) to its retracted position within the U-channel 36, the cutting blade leading sharp edge 56 will slide against the interior face of the liner lock plate main body 71, including spring biased leg 44*b* thereof, thus continuously maintaining this front portion thereof 44*b* away from wall 30 forcibly against its spring bias.

Figure 14:
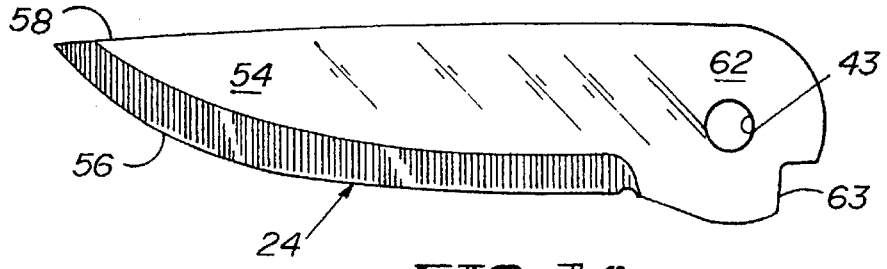
FIGS. 13 and 14 are edge and plan views of the knife blade, showing the pivotal bore and sector shape lock notch at the blade inner end portion.
Figure 13:
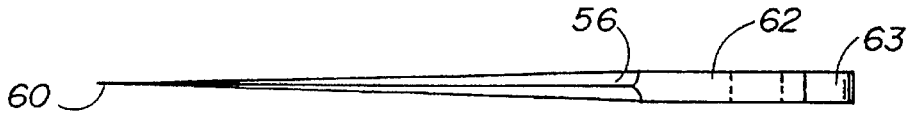

As illustrated in FIG. 14, the blade inner end portion 62 should have a sector shape lock notch 63, preferably a right-angle sector shape notch, for accommodating the front end leg portion 44*b* of the liner lock plate in the operative fully extended position of the cutting blade. It is understood that with such a right angle sector shape lock notch 63, the cutting blade 24 will become positively locked in place when it pivotally reaches its fully extended operative position, since this locking will occur automatically under the pretensioned bias of the leaf spring blade 44. More specifically, the blade 24 will become locked in its operative fully extended position (i.e., will constitute a catch member), because the sector shape notch 63 forms a seat against which the pretensioned leg 44*b* abuts under its lateral offsetting bias. To release the cutting blade 24 from its fully extended operative position, the user needs only to forcibly rearwardly slide the slider block 50, whereby the draw cable 46 will transversely pull the laterally offset spring biased finger 44*b* of the liner lock plate 70, to bring finger 44*b* coplanar to the main body 71 of the liner lock plate 70, whereby U-channel 36 becomes cleared.

It is to be considered within the scope of the present invention that in the present knife 20, the large cutting blade 24 could very well be replaced by another suitable implement, which could be selected from the group of implements conventionally found in swiss army type knives, namely:

scissors, rulers, fish scalers, files, screwdrivers, can openers, corkscrews, awls, bottle openers, nail nicks, pen blades, and the like . . .

Moreover, it is envisioned to be within the scope of the present invention that more than one knife implement could be pivotally carried to the knife handle 22. For example, a cutting blade and a can opener could be carried side by side, each pivotally mounted to a corresponding control knob (rotary button 40); the knife handle 22 would then probably have to be wider, since it would be required to have a number of transversely spaced, U-channels corresponding to that of the number of implements carried by the knife 20.

It is understood that in its folded condition, the cutting blade 24 is concealed within the U-channel 36. In this folded condition, the sharp, cutting edge 56 of the cutting blade 24 extends short of the edgewise contour of the handle 22, to prevent physical injury to the user upon hand-grasping of the handle.

Preferably, the rear arcuate end of the base J-wall 34 provides a well for receiving and accommodating in non seating fashion the sharp tip 60 of the cutting blade 24, when the cutting blade 24 occupies its folded position (FIG. 5), so as to prevent accidental injuries when the folded blade knife 20 is carried by the user.

Figure 15:
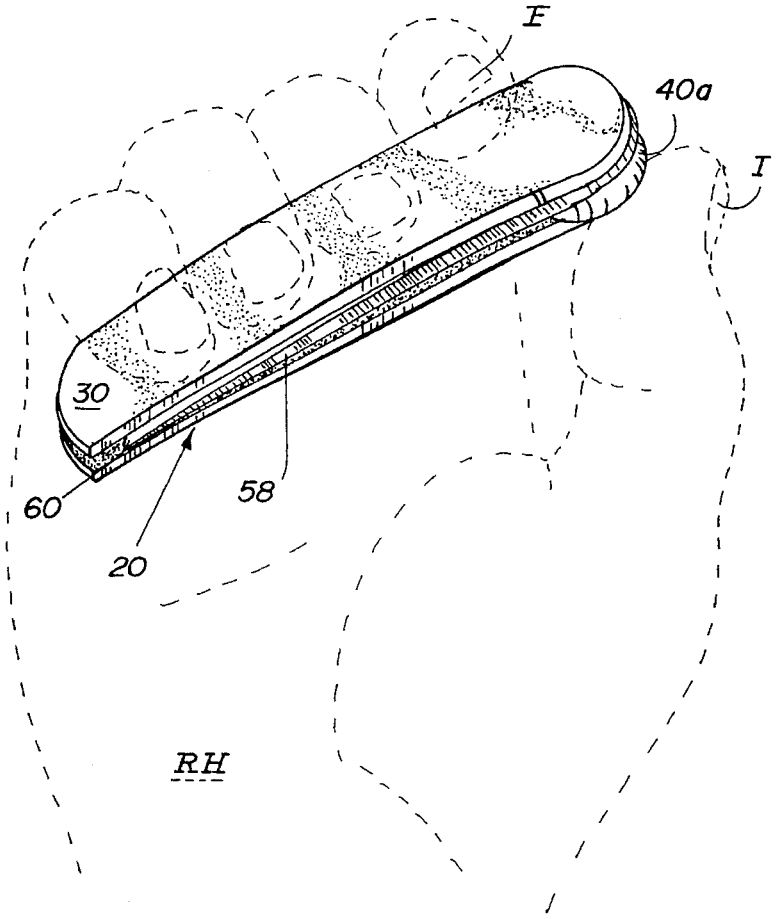
FIGS. 15 and 16 are isometric views from different perspectives of the knife of the invention in folded condition, suggesting how the knife handle can be carried in the palm of a user's hand (shown in phantom lines) and how the knurled rotary button can be manually rotated with the user's thumb of the same hand.
Figure 16:
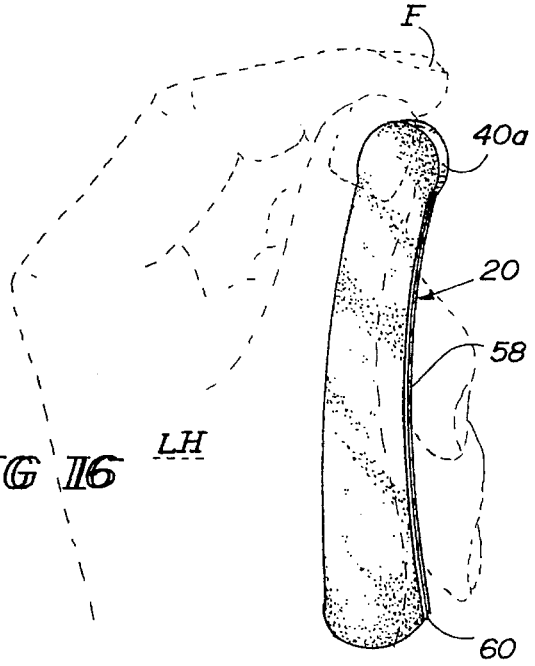

As illustrated in FIGS. 15–16, the discoid control knob 40 on this folding blade type knife 20 is used to ergonomically extend the blade thereof with the same single hand as the one supporting the handle 22, using e.g. the thumb T (for the right hand RH of a right-handed person)—FIG. 15—, or the forefinger F (for the left hand LH of a left-handed person)—FIG. 16—. In FIG. 15, the pressure of the thumb T, edgewisely on rotary button 40 and in a circular motion, clockwisely rotates the folded blade from closed to open conditions.

Figure 8:
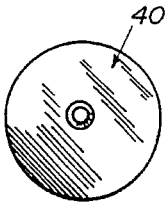
FIGS. 7–8 are plan views of opposite faces of the blade extending rotary button.
Figure 9:
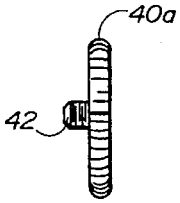
FIG. 9 is an edge view of the knurled edgewise surface of the blade extending rotary button.
Figure 7:
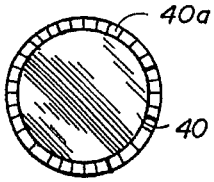
Figure 4:
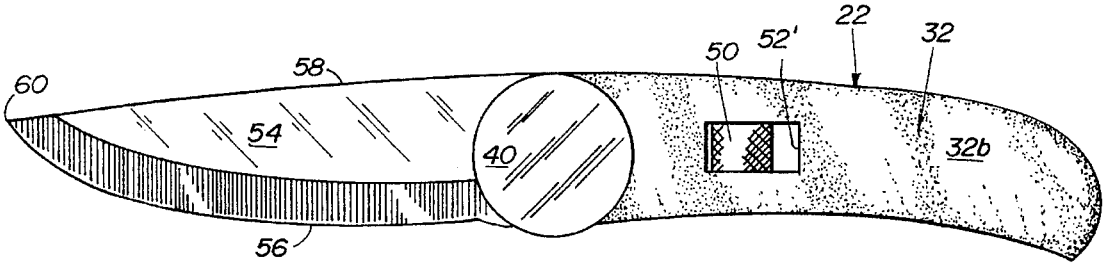
FIGS. 3 and 4 are views similar to FIGS. 1 and 2, respectively, but showing the opposite edge and side of the knife, and with the handle in FIG. 3 being partly broken for clarity of the view.

This knob 40 may be unscrewed and removed from the handle 22, as suggested in FIGS. 7 to 9 of the drawings, so as to be used as an decorative ornament: for example, by having engravings for initials or favorite animals pets' heads, etc. . . . This way, a user can custom make at will as many knobs 40 as he likes.

This knob system 40 can work on all folding blade pocket knives having an extended blade locking system called liner lock; as well as with folding blade knives having an extended blade locking system called lock back.

In conclusion, the present pocket knife 20 with a liner lock 70 has a rotary button system 40 to laterally tilt the liner lock pretensioned leg **44*b* to unlock the blade 24 when the latter is in its extended position. The mechanism (e.g. Metallic) has a flexible wire 46 attached to the liner lock finger 44*b*, which extends over a cylindrical guide roll 49 which acts as a pulley; wire 46 is further attached at the other end to the flat, checkered, control slider button 50, which can slide axially of the elongated handle 22. By moving the slider button 50 away from rotary button 40, the liner lock pretensioned leg 44*b* is laterally shifted, thus unlocking the blade 24 and freeing the latter to rotate for closing. Because the liner lock finger 44*b* is obliquely bent in the extended condition of the blade 24, it creates its own spring bias to lock the blade 24, while at the same time bringing forward the slider button 50 inside U-channel 36**.

It can be understood from FIGS. 15 and 16 that, due to the close proximity of rotary button 40 and of slider block 50, and due to the fact that both are located on the same side of the handle 22, handling of the knife 20 will be ergonomically enhanced, particularly during blade extension, since the user's finger (thumb T or forefinger F depending upon whether the user is left- or right- handed) will comfortably rotate around the circumferential edge **40*a*** of the rotary button, instead of uncomfortably entering into a wide translational motion associated with prior art handle-connected grasp members.

Therefore, the heart of the invention lies in the provision of a rotary button 40 for the blade extension of a folding knife. Preferably, a liner lock assembly—or other equivalent releasable blade locking means, such as the tenon and mortise lock back blade locking system—is provided, as an additional feature of the knife. When a blade locking means is used, preferably, the actuating knob thereof will be located closely proximate the rotary button 40 and on the same side of the knife handle.

I claim:

1. A folding blade pocket knife comprising:

(a) an elongated handle member, defining first and second, opposite, spacedly interconnected lateral walls and a lengthwise channel therebetween, and also defining front and rear ends;

(b) an elongated blade member, sized to fit within said channel, and defining a free end tip and an opposite inner end portion;

(c) a pivotal member, pivotally mounting said blade inner end portion to said handle front end, whereby said blade member is pivotable relative to said handle member between a folded position, extending within said channel, and an extended position, clearing said channel; and (d) a blade extension member, carried by said pivotal member for enabling manual ergonomically efficient pivoting of said blade member about the pivotal axis of said pivotal member;

wherein a single user's hand is required for both supporting said handle member and for operating said blade extension member;

further including blade locking means, for releasably locking said blade member in a fully extended operative position in which said handle member and said blade member are coaxial; and wherein said blade locking means includes a liner lock assembly, said liner lock assembly comprising a liner lock plate member anchored to the interior face defined by said handle first wall, said liner lock assembly including an elongated leaf spring finger, said finger being pretensioned in transversely offset fashion toward and against a front portion of said handle second wall, whereby said finger extends obliquely of said channel, said blade inner end portion including a sector shape lock notch, said blade notch being releasably engaged by said transversely offset finger automatically under the pretensioned bias thereof when said blade member reaches said operative fully extended condition thereof;

and further including means for forcibly pulling said finger transversely away from said handle second wall, against its inherent transverse offset, whereby said blade lock notch can be released for enabling blade folding.

2. A folding blade knife as defined in claim 1, wherein said pulling means includes a cable member, extending through a transverse bore made in a front portion of said handle first wall and fixedly connected at an inner end thereof to said transversely offset finger, and defining an outer end portion thereof projecting outwardly of said handle first wall.

3. A folding blade knife as defined in claim 2, wherein said blade extension member is located about said handle first wall front portion and is closely proximate the portion of said cable member projecting outwardly from said handle first wall transverse bore.

4. A folding blade knife as defined in claim 3, further including a slider block member, slidingly carried within a recess with a narrowed neck made on an exterior face of said handle first wall, wherein said cable member outer end portion is fixedly secured to said slider block member.

5. A folding blade lock knife as defined in claim 4, wherein an outer surface of said slider block member forms a generally planar, knurled surface.

6. A folding blade knife as defined in claim 5, wherein said blade extension member includes an enlarged discoid head, said pivotal member consisting of a threaded pin transversely integral to said discoid head, said threaded pin freely extending through said liner lock plate member and screwing engaging a corresponding bore made in said blade inner end portion; and said discoid head freely engaging an arcuate notch made in a front end of said handle first wall, whereby edgewise manual rotation of said discoid head provides concurrent rotation of said blade member.

7. A folding blade knife as defined in claim 6, wherein said discoid head includes a knurled circumferential edge.

8. A knife as defined in claim 1, further including a J-shape base wall, integrally joining said handle lateral walls on their side opposite said channel, whereby the arcuate end portion formed by the J of the J-shape base wall defines a well for accommodating in a non-seating fashion said blade end tip, whereby said blade tip extends short of and is concealed by said handle lateral side walls when said blade member occupies its said folded position.

9. A folding blade pocket knife comprising:

(a) an elongated handle member defining first and second, opposite, spacedly interconnected lateral walls and a lengthwise channel therebetween, and also defining front and rear ends;

(b) an elongated blade member, sized to fit within said channel, and defining free end tip and an opposite inner end portion;

(c) a pivotal member, pivotally mounting said blade inner end portion to said handle front end, whereby said blade member is pivotable relative to said handle member between a folded position, extending within said channel, and an extended position, clearing said channel; and (d) a blade extension member, carried by said pivotal member for enabling manual ergonomically efficient pivoting of said blade member about the pivotal axis of said pivotal member;

wherein a single user's hand is required for both supporting said handle member and for operating said blade extension member;

wherein said blade extension member includes an enlarged discoid head, said discord head freely engaging an arcuate notch made in a front end of said handle first wall, whereby edgewise manual rotation of said discoid head provides concurrent rotation of said blade member.

10. A folding blade knife as defined in claim 9, wherein said discoid head includes a knurled circumferential edge.

* * * * *